US006972521B2

(12) United States Patent
Scholl et al.

(10) Patent No.: US 6,972,521 B2
(45) Date of Patent: Dec. 6, 2005

(54) LOW-PRESSURE GAS DISCHARGE LAMP HAVING A MERCURY-FREE GAS FILLING WITH AN INDIUM COMPOUND

(75) Inventors: Robert Peter Scholl, Roetgen (DE); Rainer Hilbig, Aachen (DE); Achim Koerber, Kerkrade (NL); Johannes Baier, Wuerselen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 72 days.

(21) Appl. No.: 09/947,777

(22) Filed: Sep. 7, 2001

(65) Prior Publication Data

US 2002/0047525 A1 Apr. 25, 2002

(30) Foreign Application Priority Data

Sep. 8, 2000 (DE) ..... 100 44 562

(51) Int. Cl.[7] ..... H01J 17/20
(52) U.S. Cl. ..... 313/637; 313/638
(58) Field of Search ..... 313/637, 638, 313/643, 568, 567, 576, 570, 571

(56) References Cited

U.S. PATENT DOCUMENTS

| | | | | |
|---|---|---|---|---|
| 3,657,591 A * | 4/1972 | Johnson | 315/354 |
| 4,314,175 A * | 2/1982 | Jacobs et al. | 313/552 |
| 4,427,922 A * | 1/1984 | Proud et al. | 315/248 |
| 4,733,338 A * | 3/1988 | Feher et al. | 362/310 |
| 4,937,496 A * | 6/1990 | Neiger et al. | 313/632 |
| 5,394,204 A * | 2/1995 | Shigeta et al. | 353/31 |
| 5,691,601 A * | 11/1997 | Frey et al. | 313/571 |
| 5,859,496 A * | 1/1999 | Murazaki et al. | 313/485 |
| 5,965,984 A * | 10/1999 | Horiuchi et al. | 313/637 |
| 6,040,658 A * | 3/2000 | Bashlov et al. | 313/637 |
| 6,069,456 A * | 5/2000 | Fromm et al. | 315/248 |
| 6,072,268 A * | 6/2000 | Dolan et al. | 313/112 |
| 6,157,141 A * | 12/2000 | Lapatovich et al. | 315/248 |
| 6,603,267 B2 * | 8/2003 | Hilbig et al. | 313/637 |
| 6,731,070 B2 * | 5/2004 | Scholl et al. | 313/643 |
| 6,815,895 B2 * | 11/2004 | Hirao | 313/637 |
| 6,879,101 B2 * | 4/2005 | Deguchi et al. | 313/569 |

FOREIGN PATENT DOCUMENTS

| | | | |
|---|---|---|---|
| GB | 2014358 A | 8/1979 | |
| JP | 3239721 | * 5/1997 | H01J 61/20 |
| SU | 1191982 | * 11/1985 | H01J 61/22 |

* cited by examiner

*Primary Examiner*—Joseph Williams
*Assistant Examiner*—Dalei Dong

(57) ABSTRACT

A low-pressure gas discharge lamp provided with a gas discharge vessel containing a mercury-free gas filling with an indium compound in an amount of about 1 to 10 microgram per cubic centimeter and a partial pressure in the range from 1.0 to 30 micro bar, and a buffer gas for emitting radiation in a continuous spectrum in the visible and near UVA regions of the electromagnetic spectrum, which low-pressure gas discharge lamp is also provided with electrodes and a ballast for controlling the ignition and operation of the lamp.

14 Claims, 1 Drawing Sheet

LOW-PRESSURE GAS DISCHARGE LAMP HAVING A MERCURY-FREE GAS FILLING WITH AN INDIUM COMPOUND

TECHNICAL FIELD

The invention relates to a low-pressure gas discharge lamp comprising a gas discharge vessel with a gas filling, means for generating and maintaining a low-pressure gas discharge.

BACKGROUND AND SUMMARY

Light generation in most conventional low-pressure gas discharge lamps is based on the principle that charge carriers, particularly electrons but also ions, are accelerated so strongly by an electric field between the electrodes of the lamp that collisions with the gas atoms or molecules in the gas filling of the lamp cause these gas atoms or molecules to be excited or ionized. When the atoms or molecules of the gas filling return to the ground state, a more or less substantial part of the excitation energy is converted to radiation.

Conventional low-pressure gas discharge lamps comprise mercury in the gas filling and, in addition, a phosphor coating on the inside of the gas discharge vessel. A drawback of the mercury low-pressure gas discharge lamps resides in that mercury vapor primarily emits radiation in the high-energy, yet invisible UV-C range of the electromagnetic spectrum, which radiation must first be converted by the phosphors to visible radiation with a much lower energy level. In this process, the energy difference is converted to undesirable thermal radiation.

In addition, the mercury in the gas filling is being regarded more and more as an environmentally harmful and toxic substance that should be avoided as much as possible in present-day mass-products as its use, production and disposal pose a threat to the environment.

It is known already that the spectrum of low-pressure gas discharge lamps can be influenced by substituting the mercury in the gas filling with other substances.

For example, GB 2 014 658 A discloses a low-pressure gas discharge lamp comprising a discharge vessel, electrodes and a filling which contains at least a copper halogenide as the UV emitter. This copper halogenide-containing low-pressure gas discharge lamp emits in the visible range as well as in the UV range at 324.75 and 327.4 nm.

It is an object of the invention to provide a low-pressure gas discharge lamp the radiation of which is as close as possible to the visible region of the electromagnetic spectrum.

In accordance with the invention, this object is achieved by a low-pressure gas discharge lamp provided with a gas discharge vessel containing a gas filling with an indium compound and a buffer gas, which low-pressure gas discharge lamp is also provided with means for generating and maintaining a low-pressure gas discharge.

In the lamp in accordance with the invention, a molecular gas discharge takes place at a low pressure, which gas discharge emits radiation in the visible and near UVA region of the electromagnetic spectrum. Apart from the characteristic lines of indium at 410 and 451 nm, said radiation also includes a wide continuous spectrum in the range from 320 to 450 nm. As this radiation originates from a molecular discharge, the type of indium compound, possible further additives as well as the internal pressure of the lamp and the operating temperature enable the exact position of the continuous spectrum to be controlled.

In combination with phosphors, the lamp in accordance with the invention has a visual efficiency which is substantially higher than that of conventional low-pressure mercury discharge lamps. The visual efficiency, expressed in lumen/Watt, is the ratio between the brightness of the radiation in a specific visible wavelength range and the energy for generating the radiation. The high visual efficiency of the lamp in accordance with the invention means that a specific quantity of light is obtained at a smaller power consumption. Besides, the use of mercury is avoided.

As an UV-A lamp, the lamp in accordance with the invention is advantageously used for sunbeds, and as a disinfecting lamp and a lacquer-curing lamp. For general illumination purposes, the lamp is combined with appropriate phosphors. As the losses caused by Stokes' displacement are small, visible light having a high luminous efficiency above 100 lumen/Watt is obtained.

Within the scope of the invention it may be preferred that the indium compound is selected from the group formed by the halogenides, oxides, chalcogenides, hydroxides and metalorganic compounds of indium.

A gas filling with indium halogenides is particularly preferred.

The efficiency is further improved if the gas filling contains a mixture of two indium halogenides.

It may be alternatively preferred for the gas filling to comprise, as a further additive, a compound of thallium, which is selected from the group formed by the halogenides, oxides, chalcogenides, hydroxides, hydrides and metalorganic compounds of thallium. As a result, a gas discharge with a wide continuous spectrum is obtained.

The gas filling may also advantageously comprise a halogenide selected from the halogenides of copper and the alkaline metals as a further additive.

Particularly advantageous effects in comparison with the prior art are achieved by the invention if the gas filling comprises a halogenide of indium and a halogenide of thallium in the molar ratio of 1:1.

For the buffer gas, the gas filling may comprise an inert gas selected from the group formed by helium, neon, argon, krypton and xenon. Advantageously, the gas pressure of the inert gas at the operating temperature ranges from 2 to 10 mbar, with 3.4 mbar being the preferred value.

Within the scope of the invention it may be preferred that the gas discharge vessel comprises a phosphor coating on the outside surface. The UVA radiation emitted by the low-pressure gas discharge lamp in accordance with the invention is not absorbed by the customary glass types, but goes through the walls of the discharge vessel substantially free of losses. Therefore, the phosphor coating can be provided on the outside of the gas discharge vessel. This results in a simplification of the manufacturing process.

Within the scope of the invention it is particularly preferred that the gas filling contains indium halogenide at a partial pressure in the range from 1.0 to 30.0 $\mu$bar, thallium halogenide at a partial pressure <1.0 $\mu$bar and argon at a partial pressure in the range from 2 to 10 mbar. Said pressure levels relate to the relevant operating temperature.

BRIEF DESCRIPTION OF THE DRAWING

These and other aspects of the invention will be apparent from and elucidated with reference to a drawing and 3 embodiments.

In the drawing.

DETAILED DESCRIPTION

Figure 1:
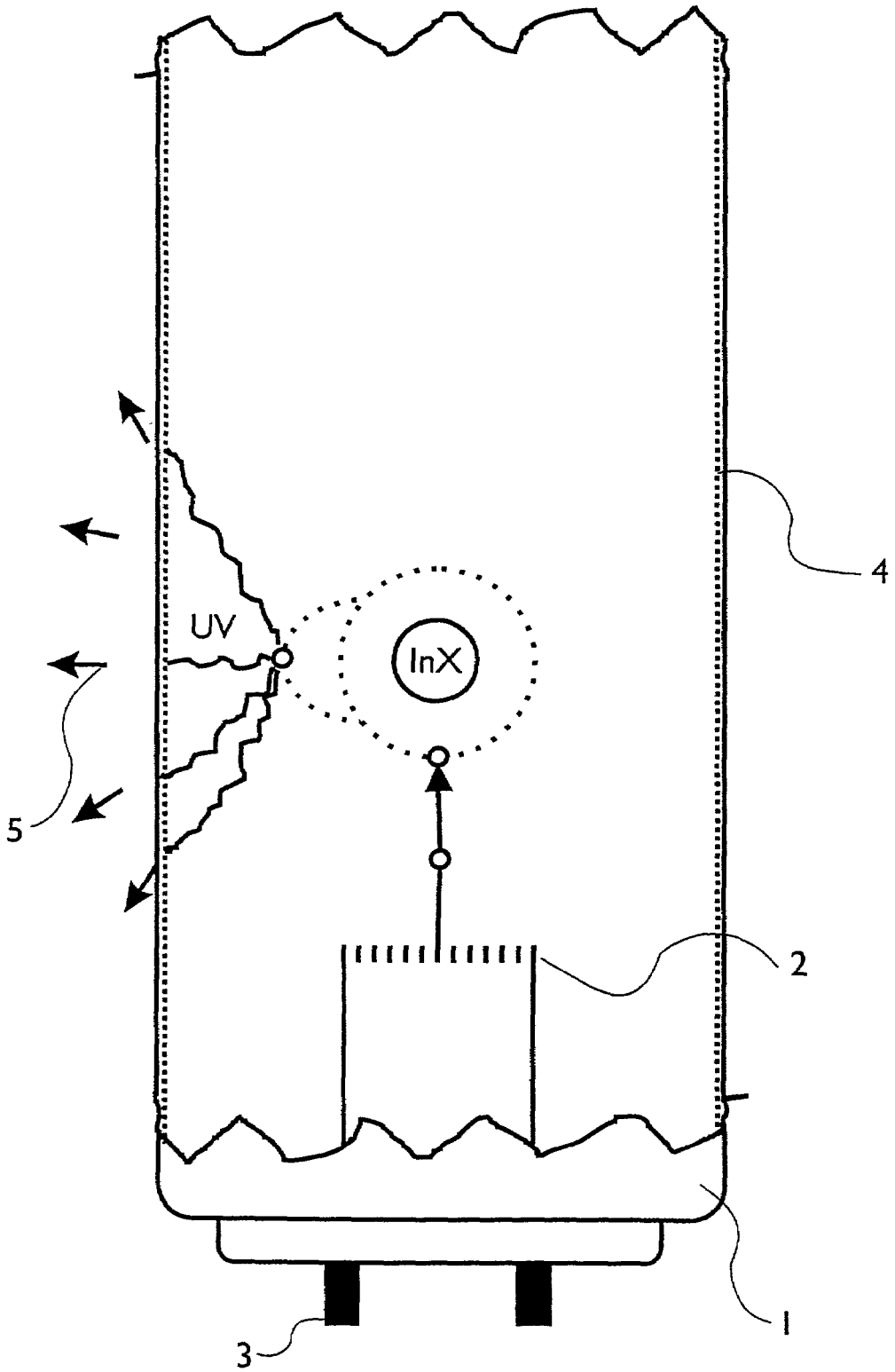
FIG. 1 diagrammatically shows the light generation in a low-pressure gas discharge lamp comprising a gas filling containing an indium (I) compound.

In the embodiment shown in FIG. 1, the low-pressure gas discharge lamp in accordance with the invention is composed of a tubular lamp bulb 1, which surrounds a discharge space. At both ends of the tube, inner electrodes 2 are sealed in, via which electrodes the gas discharge can be ignited. The low-pressure gas discharge lamp comprises a lamp holder and a lamp cap 3. An electrical ballast is integrated in known manner in the lamp holder or in the lamp cap, which ballast is used to control the ignition and the operation of the gas discharge lamp. In a further embodiment, not shown in FIG. 1, the low-pressure gas discharge lamp can alternatively be operated and controlled via an external ballast.

The gas discharge vessel may alternatively be embodied so as to be a multiple-bent or coiled tube surrounded by an outer bulb. The wall of the gas discharge vessel is preferably made of a glass type which is transparent to UV-A radiation of a wavelength between 320 and 450 nm.

For the gas filling use is made, in the simplest case, of an indium halogenide in a quantity of 1 to 10 $\mu g/cm^3$ and an inert gas. The inert gas serves as a buffer gas enabling the gas discharge to be more readily ignited. For the buffer gas use is preferably made of argon. Argon may be substituted, either completely or partly, with another inert gas, such as helium, neon, krypton or xenon.

The lumen efficiency can be dramatically improved by adding an additive selected from the group formed by the halogenides of thallium, copper and alkaline metals to the gas filling. The efficiency can also be improved by combining two or more indium halogenides in the gas atmosphere.

The efficiency can be further improved by optimizing the internal pressure of the lamp during operation. The cold filling pressure of the buffer gas is maximally 10 mbar. Preferably, said pressure lies in a range between 1.0 and 2.5 mbar.

It has been found that, in accordance with a further advantageous measure, an increase of the lumen efficiency of the low-pressure gas discharge lamp can be achieved by controlling the operating temperature of the lamp by means of suitable constructional measures. The diameter and the length of the lamp are chosen to be such that, during operation at an outside temperature of 25° C., an inside temperature in the range from 170 to 285° C. is attained. This inside temperature relates to the coldest spot of the gas discharge vessel as the discharge brings about a temperature gradient in the vessel.

To increase the inside temperature, the gas discharge vessel may also be coated with an infrared radiation-reflecting coating. Preferably, use is made of an infrared radiation-reflecting coating of indium-doped tin oxide.

In this case it was found that, in a low-pressure gas discharge lamp with a gas filling containing indium chloride, the temperature of the coldest spot should lie in the range from 170 to 210° C., preferably 200° C., at the operating temperature. Analogously, in the case of a gas filling containing indium bromide, the temperature of the coldest spot should lie in the range from approximately 210 to 250° C., preferably at approximately 250° C.

In the case of a gas filling containing indium iodide, the temperature of the coldest spot should lie in the range from approximately 200 to 285° C., preferably at approximately 255° C.

A combination of the three measures mentioned hereinabove also proved to be advantageous.

A suitable material for the electrodes in the low-pressure gas discharge lamp in accordance with one embodiment of the invention comprises, for example, nickel, a nickel alloy or a metal having a high melting point, in particular tungsten and tungsten alloys. Also composite materials of tungsten with thorium oxide or indium oxide can suitably be used.

In the embodiment in accordance with FIG. 1, the outside surface of the gas discharge vessel of the lamp is coated with a phosphor layer 4. The UV-radiation originating from the gas discharge excites the phosphors in the phosphor layer so as to emit light in the visible region 5.

The chemical composition of the phosphor layer determines the spectrum of the light or its tone. The materials that can suitably be used as phosphors must absorb the radiation generated and emit said radiation in a suitable wavelength range, for example for the three basic colors red, blue and green, and enable a high fluorescence quantum yield to be achieved.

Suitable phosphors and phosphor combinations must not necessarily be applied to the inside of the gas discharge vessel; they may alternatively be applied to the outside of the gas discharge vessel as the customary glass types do not absorb UVA radiation.

In accordance with another embodiment, the lamp is capacitively excited using a high frequency field, the electrodes being provided on the outside of the gas discharge vessel.

In accordance with a further embodiment, the lamp is inductively excited using a high frequency field.

When the lamp is ignited, the electrons emitted by the electrodes or by inductive means excite the atoms and molecules of the gas filling so as to emit UV radiation from the characteristic radiation and a continuous spectrum in the range between 320 and 450 nm.

The discharge heats up the gas filling such that the desired vapor pressure and the desired operating temperature ranging from 170° C. to 285° C. is achieved at which the light output is optimal.

The radiation from the indium halogenide-containing gas filling generated during operation exhibits, apart from the line spectrum of the elementary indium at 410 nm and 451 nm, an intensive, wide continuous molecular spectrum between 340 and 420 nm, which is brought about by molecular discharge of the indium halogenide. The maximum emission range of the continuous molecular spectrum shifts to longer wavelengths as the molecular weight of the indium halogenide increases.

EXAMPLE 1

A cylindrical discharge vessel of glass, which is transparent to UV-A radiation, having a length of 15 cm and a diameter of 2.5 cm is provided with inner electrodes of tungsten. The discharge vessel is evacuated and simultaneously a dose of 0.3 mg indium bromide is added. Also argon is introduced at a cold pressure of 1.7 mbar. An alternating current originating from an external alternating current source is supplied and the lumen efficiency is measured at an operating temperature of 225° C. The lumen efficiency is 100 lm/W.

EXAMPLE 2

A cylindrical discharge vessel of glass, which is transparent to UV-A radiation, having a length of 15 cm and a diameter of 2.5 cm is provided with outer electrodes of copper. The discharge vessel is evacuated and simultaneously a dose of indium bromide, indium iodide and argon is added for the gas filling, so that, at the operating temperature, a partial pressure in the range from 5.0 to 15.0 $\mu$bar for indium bromide, a partial pressure in the range from 0.5 to 1.5 $\mu$bar for indium iodide and a partial pressure of 5.0 mbar for argon is achieved.

A high frequency field having a frequency of 13.5 MHz is supplied from an external source and, at an operating temperature of 240° C., a lumen efficiency of 85 lm/W is measured.

EXAMPLE 3

A cylindrical discharge vessel of glass, which is transparent to UV-A radiation, having a length of 15 cm and a diameter of 2.5 cm is provided with inner electrodes of tungsten. The discharge vessel is evacuated and simultaneously a dose of indium bromide, thallium iodide and argon is added for the gas filling, so that, at the operating temperature, a partial pressure in the range from 1.0 to 10.0 $\mu$bar for indium bromide, a partial pressure <1 $\mu$bar for thallium iodide and a partial pressure of 5.0 mbar for argon is achieved.

An alternating current originating from an external alternating current source is supplied, and, at an operating temperature of 210±10° C., a lumen efficiency of 90 lm/W is measured.

What is claimed is:

1. A low-pressure gas discharge lamp provided with a gas discharge vessel containing a mercury-free gas filling with an indium compound in an amount of about 1 to 10 $\mu g/cm^3$ and a partial pressure in the range from 1.0 to 30.0 $\mu$bar, and a buffer gas, which low-pressure gas discharge lamp is also provided with means for generating and maintaining a low-pressure gas discharge, the lamp emitting radiation in a continuous spectrum in the visible and near UVA regions of the electromagnetic spectrum.

2. A low-pressure gas discharge lamp as claimed in claim 1, characterized in that the indium compound is selected from the group formed by halogenides, oxides, chalcogenides, hydroxides and the metalorganic compounds of indium.

3. A low-pressure gas discharge lamp as claimed in claim 1, characterized in that the indium compound is selected from the group formed by the halogenides.

4. A low-pressure gas discharge lamp as claimed in claim 1, characterized in that the gas filling comprises a mixture of two indium halogenides.

5. A low-pressure gas discharge lamp as claimed in claim 4, characterized in that the gas filling comprises indium halogenide at a partial pressure in the range from 1.0 to 10.0 $\mu$bar, thallium halogenide at a partial pressure <1.0 $\mu$bar and argon at a partial pressure in the range from 2 to 10 mbar.

6. A low-pressure gas discharge lamp as claimed in claim 1, characterized in that the gas filling comprises, as a further additive, a compound of thallium, selected from the group formed by the halogenides, oxides, chalcogenides, hydroxides, hydrides and metalorganic compounds of thallium.

7. A low-pressure gas discharge lamp as claimed in claim 1, characterized in that the gas filling comprises, as a further additive, a halogenide selected from the halogenides of copper and the alkaline metals.

8. A low-pressure gas discharge lamp as claimed in claim 1, characterized in that the gas filling comprises a halogenide of indium and a halogenide of thallium in the molar ratio of 1:1.

9. A low-pressure gas discharge lamp as claimed in claim 1, characterized in that the gas filling comprises an inert gas, selected from the group formed by helium, neon, argon, krypton and xenon, as the buffer gas.

10. A low-pressure gas discharge lamp as claimed in claim 9, characterized in that the gas filling comprises an inert gas, selected from the group formed by helium, neon, argon, krypton and xenon, as the buffer gas, the gas pressure at the operating temperature ranging from 2 to 10 mbar.

11. A low-pressure gas discharge lamp as claimed in claim 10, characterized in that the gas filling comprises an inert gas, selected from the group formed by helium, neon, argon, krypton and xenon, as the buffer gas, the gas pressure at the operating temperature being 3.4 mbar.

12. A low-pressure gas discharge lamp as claimed in claim 1, characterized in that the gas discharge vessel comprises a phosphor coating applied to the outside surface.

13. A low-pressure gas discharge lamp as claimed in claim 1, characterized in that the means for generating and maintaining a low-pressure gas discharge comprise means including electrodes for electrical excitation.

14. A low-pressure gas discharge lamp as claimed in claim 1, characterized in that the means for generating and maintaining a low-pressure gas discharge comprise means for inductive excitation.

* * * * *